US006599468B2

(12) United States Patent
Okuyama et al.

(10) Patent No.: US 6,599,468 B2
(45) Date of Patent: Jul. 29, 2003

(54) POWDER COMPACTING APPARATUS AND METHOD OF MAKING RARE-EARTH ALLOY MAGNETIC POWDER COMPACT

(75) Inventors: Shuichi Okuyama, Hyogo (JP); Tsutomu Harada, Osaka (JP); Takashi Tajiri, Osaka (JP)

(73) Assignee: Sumitomo Special Metals Co., Ltd. (JP)

( * ) Notice: Subject to any disclaimer, the term of this patent is extended or adjusted under 35 U.S.C. 154(b) by 0 days.

(21) Appl. No.: 09/818,930

(22) Filed: Mar. 28, 2001

(65) Prior Publication Data

US 2002/0018730 A1 Feb. 14, 2002

(30) Foreign Application Priority Data

Mar. 28, 2000 (JP) ..... 2000-088825

(51) Int. Cl.[7] ..... B22F 3/02

(52) U.S. Cl. ..... 419/66; 425/78; 148/108; 148/307

(58) Field of Search ..... 419/66; 425/78; 148/301, 108

(56) References Cited

U.S. PATENT DOCUMENTS

| | | | | |
|---|---|---|---|---|
| 5,250,255 A | * | 10/1993 | Sagawa et al. | 419/39 |
| 5,383,978 A | | 1/1995 | Yamamoto et al. | 148/101 |
| 6,332,932 B1 | * | 12/2001 | Kohara et al. | 148/301 |
| 6,413,457 B1 | * | 7/2002 | Fukushima et al. | 264/109 |

FOREIGN PATENT DOCUMENTS

| | | | |
|---|---|---|---|
| EP | 0 999 039 | | 5/2000 |
| EP | 1 020 285 | | 7/2000 |
| JP | 63-033505 | | 2/1988 |
| JP | 02-240201 | | 9/1990 |
| JP | 06-218587 | | 8/1994 |
| JP | 09-035978 | | 2/1997 |
| JP | 09150298 A | * | 6/1997 |
| JP | 2000-197997 | | 7/2000 |
| JP | 2000-248301 | | 9/2000 |
| JP | 2000254907 A | * | 9/2000 |

OTHER PUBLICATIONS

Specifications and Drawings for Application Serial No. 09/469,620, "Powder Pressing Apparatus, Punch, Method for Pressing Powder and Method for Manufacturing the Punch" Filing Date: Dec. 22, 1999, Inventors: Sadatoshi Fukushima et al.

Specifications and Drawings for Application Serial No. 09/472,247, "Process and Apparatus for Supplying Rare Earth Metal–Based Alloy Powder" Filing Date: Dec. 27, 1999, Inventors: Seiichi Kohara et al.

* cited by examiner

*Primary Examiner*—Ngoclan Mai
(74) *Attorney, Agent, or Firm*—Nixon Peabody LLP; Jeffrey L. Costellia

(57) ABSTRACT

The present invention provides a powder compacting apparatus including: a die having a through hole forming a cavity; a first punch and a second punch for pressing a rare-earth alloy magnetic powder filled in the cavity; and a magnetic field generator for applying an orientation magnetic field parallel to a pressing direction through the rare-earth alloy magnetic powder in the cavity, wherein at least one of the first and second punches and has a curved pressing surface, and the pressing surface is given a shape such as to suppress the movement of particles of the rare-earth alloy magnetic powder along the pressing surface during the pressing step.

29 Claims, 9 Drawing Sheets

BEFORE PRESSURIZATION
(with applied magnetic field)

AFTER PRESSURIZATION

BEFORE PRESSURIZATION
(with applied magnetic field)

AFTER PRESSURIZATION

POWDER COMPACTING APPARATUS AND METHOD OF MAKING RARE-EARTH ALLOY MAGNETIC POWDER COMPACT

FIELD OF THE INVENTION

The present invention relates to an apparatus and method for making a rare-earth alloy magnetic powder compact and a method of producing a rare-earth magnet.

BACKGROUND OF THE INVENTION

A rare-earth alloy magnet is made through compaction by pressing a magnetic powder that has been obtained by pulverizing a rare-earth alloy. Currently, two types of rare-earth alloy sintered magnets are widely used in various fields: samarium-cobalt magnets and neodymium-iron-boron magnets. Particularly, neodymium-iron-boron magnets (hereinafter, referred to as "R—T—B magnets", wherein R denotes a rare-earth element and/or Yttrium, T denotes iron and/or a transition metal element substituting part of iron, and B denotes boron.) have been actively employed in various electronic devices because they exhibit the highest magnetic energy product among various magnets and are relatively inexpensive. As an example of a transition metal included in T, Co may be used.

As the variety of applications of rare-earth alloy magnets expands, there is a demand for production of magnets of various shapes. The production of a high-performance motor, for example, requires a plurality of strong anisotropic magnets having a curved surface. In order to produce such an anisotropic magnet, it is necessary to press a magnetic powder oriented in a magnetic field to make a powder compact having a desired shape. A high-performance rotating machine such as a voice coil motor uses a plurality of thin-plate magnets having a C-shaped or arc-shaped cross section. In order to improve the performance of a rotating machine, merely increasing the magnetization of the magnet is not sufficient. It is necessary to obtain the shape of the magnet and the magnetic field distribution in the vicinity of the magnet surface without distortion.

In the prior art, the pressing surface of a mold pressing member of a compacting apparatus is curved to give a desired curved surface to a powder compact. According to such a conventional technique, the pressing surface is mirror-finished.

However, experiments by the present inventors have revealed that where the pressing direction coincides with the direction of the orientation of the magnetic field, if a mirror-finished curved surface exists in the pressing surface, the orientation of the magnetic powder is disturbed, and optimal magnetic properties are not exhibited. Particularly, when a permanent magnet is made from a compact whose orientation has been disturbed and the permanent magnet is used to produce a motor, a non-negligible level of undesirable reluctance torque or cogging torque of the motor is obserbed. A cogging torque is generated due to changes in reluctance of magnetic circuits in the motor as the rotor rotates. When a change in reluctance occurs, a torque (unintended in the design of the motor) is produced. That torque is usually quite small with respect to the intended torque which the motor produces. However, that torque may be large enough to be disruptive in a number of applications for permanent magnet motors, such as electric power steering and electric suspensions for motor vehicles. In such applications, the cogging torque may be enough to be felt by people in the motor vehicle.

SUMMARY OF THE INVENTION

It is an object of this invention to provide a compacting apparatus with a curved surface in which orientation disturbance of resulting compacts is suppressed, and which is suitable for making a rare-earth alloy magnetic powder compact whose particles are oriented in a direction parallel to the direction of the magnetic field.

Another object of the present invention is to provide a method of making a rare-earth alloy magnetic powder compact in which the orientation disturbance is suppressed by using such a compacting apparatus, a method of producing a rare-earth magnet, and a rare-earth magnet.

Still another object of the present invention is to provide a powder pressing die set used in such a compacting apparatus.

A powder compacting apparatus of an embodiment of the present invention includes: a die having a through hole forming a cavity; a first punch and a second punch for pressing a rare-earth alloy magnetic powder filled in the cavity; and magnetic field generation means for applying an orientation magnetic field parallel to a pressing direction through the rare-earth alloy magnetic powder in the cavity, wherein at least one of the first and second punches has a curved pressing surface; and the pressing surface is given a shape such as to suppress a movement of particles of the rare-earth alloy magnetic powder along the pressing surface during a pressing process.

In a preferred embodiment, a pattern is formed on the pressing surface, the pattern including concave portions and/or convex portions extending in a direction generally parallel to a reference plane that is perpendicular to the pressing direction.

In a preferred embodiment, the pressing surface includes a plurality of minute surfaces generally parallel to a reference plane that is perpendicular to the pressing direction, and the plurality of minute surfaces extend in a same direction, and the minute surfaces are separated from adjacent surfaces by a step.

In a preferred embodiment, each of the plurality of minute surfaces has a width of 0.1 mm or less.

In a preferred embodiment, concave portions with a depth of 0.1 mm or less and/or convex portions with a height of 0.1 mm or less are arranged on the pressing surface.

In a preferred embodiment, the pressing surface is not mirror-finished and has a surface roughness Ra equal to or greater than 0.05 $\mu$m and less than or equal to 12.5 $\mu$m.

In a preferred embodiment, the pressing surface is curved in an arch shape as a whole.

A method of making a rare-earth alloy magnetic powder compact of the present invention includes the step of making a compact of a rare-earth alloy magnetic powder by using any of the above-described powder compacting apparatuses.

In a preferred embodiment, the rare-earth alloy magnetic powder is made from an Fe—R—B (wherein R denotes a rare-earth element and B denotes boron) alloy.

A method of producing a rare-earth magnet of the present invention includes the steps of making a compact of a rare-earth alloy magnetic powder by using any of the above-described powder compacting apparatuses; and making a permanent magnet from the compact.

In a preferred embodiment, the rare-earth alloy magnetic powder is made from an Fe—R—B alloy, wherein R denotes a rare-earth element and B denotes boron.

A powder pressing die set of the present invention includes a punch having a curved pressing surface, wherein the pressing surface is given a shape such as to suppress a movement of powder particles along the pressing surface during a pressing process.

In a preferred embodiment, a pattern is formed on the pressing surface, the pattern including concave portions and/or convex portions generally parallel to a reference plane that is perpendicular to a pressing direction.

In a preferred embodiment, the pressing surface includes a plurality of minute surfaces generally parallel to a reference plane that is perpendicular to a pressing direction, and the plurality of minute surfaces extend in a same direction, and the minute surfaces are separated from adjacent surfaces by a step.

In a preferred embodiment, each of the plurality of minute surfaces has a width of 0.1 mm or less.

In a preferred embodiment, concave portions with a depth of 0.1 mm or less and/or convex portions with a height of 0.1 mm or less are arranged on the pressing surface.

In a preferred embodiment, the pressing surface is not mirror-finished and has a surface roughness Ra between 0.05 $\mu$m and 12.5 $\mu$m.

In a preferred embodiment, the pressing surface is curved in an arch shape.

A rare-earth magnet of the present invention is a rare-earth magnet wherein a pattern is formed on a surface thereof, the pattern including concave portions and/or convex portions extending in a direction generally parallel to a reference plane that is perpendicular to a pressing direction.

Another rare-earth magnet of the present invention includes a surface including a plurality of minute surfaces generally parallel to a reference plane that is perpendicular to a pressing direction, and the plurality of minute surfaces extend in a same direction, and the minute surfaces are separated from adjacent surfaces by a step.

In a preferred embodiment, each of the plurality of minute surfaces has a width of 0.1 mm or less.

Still another rare-earth magnet of the present invention includes a surface including a plurality of strip-shaped flat surfaces extending in a direction generally parallel to a reference plane that is perpendicular to a pressing direction.

BRIEF DESCRIPTION OF THE DRAWINGS

Each of FIG. 5A

DESCRIPTION OF THE PREFERRED EMBODIMENTS

The present inventors have found that if a curved surface (or an inclined surface) exists in a pressing surface of a pressing member when pressing a magnetic powder that is oriented in a magnetic field having a direction parallel to the pressing direction, a magnetic orientation disturbance occurs in the powder particles in the vicinity of the pressing surface due to the force exerted by the curved pressing surface upon the powder, and moreover the magnetic orientation disturbance gives an adverse influence on the inside of the powder compact, whereby the orientation direction of the compact is not parallel to the direction of the orientation magnetic field.

In order to suppress such an orientation disturbance, according to the present invention, a concave/convex pattern is formed on the pressing surface so as to suppress the movement of the magnetic powder particles along the pressing surface, in a direction generally perpendicular to the pressing direction.

As discussed hereinbelow, magnetic powder particles placed in an orientation magnetic field are coupled with one another in the direction of the magnetic field due to the magnetic interaction, and move collectively. The present inventors assumed that the behavior of the powder particles on the pressing surface gives a significant influence on the behavior/orientation of the other particles inside the powder compact, and attempted to improve the shape of the pressing surface. As a result, the present inventors successfully improved the magnetic properties of a final magnet product.

An embodiment of the present invention will now be described with reference to the accompanying drawings.

Compacting Apparatus

Figure 1A:
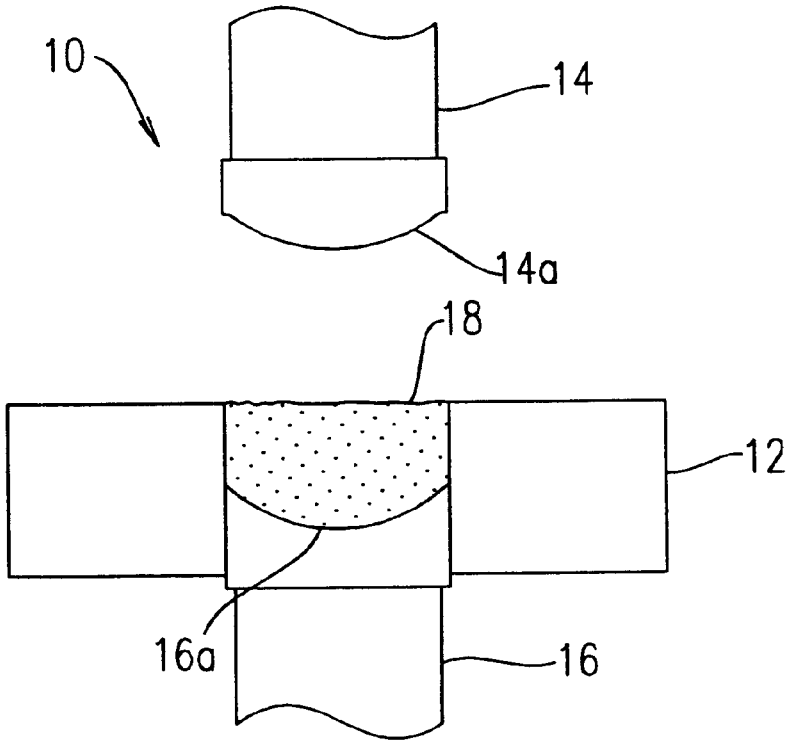
FIG. 1A and FIG. 1B illustrate a main part of a powder compacting apparatus 10 used in one embodiment of the present invention.
Figure 1B:
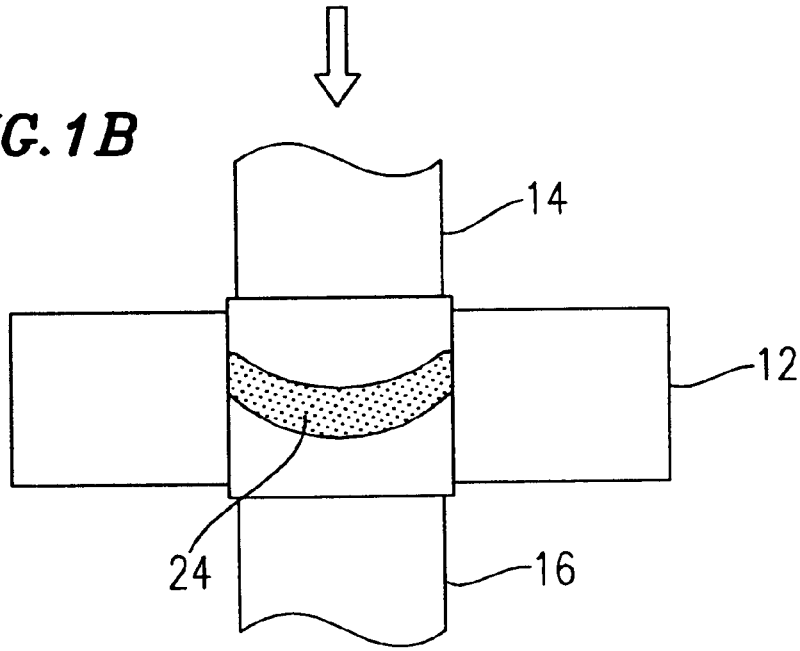

FIG. 1A and FIG. 1B illustrate a main part of a powder compacting apparatus 10 used in a present embodiment of the invention. The illustrated compacting apparatus 10 includes a die 12 having a through hole (die hole) forming a cavity, and an upper punch 14 and a lower punch 16 for compressing a magnetic powder in the through hole. The die set, which includes the die 12, the upper punch 14 and the lower punch 16, is connected to a driving device (not shown) for the vertical pressing motion required in the pressing step. The basic operation of the compacting apparatus of the present embodiment is carried out as the operation of a known compacting apparatus.

Figure 2:
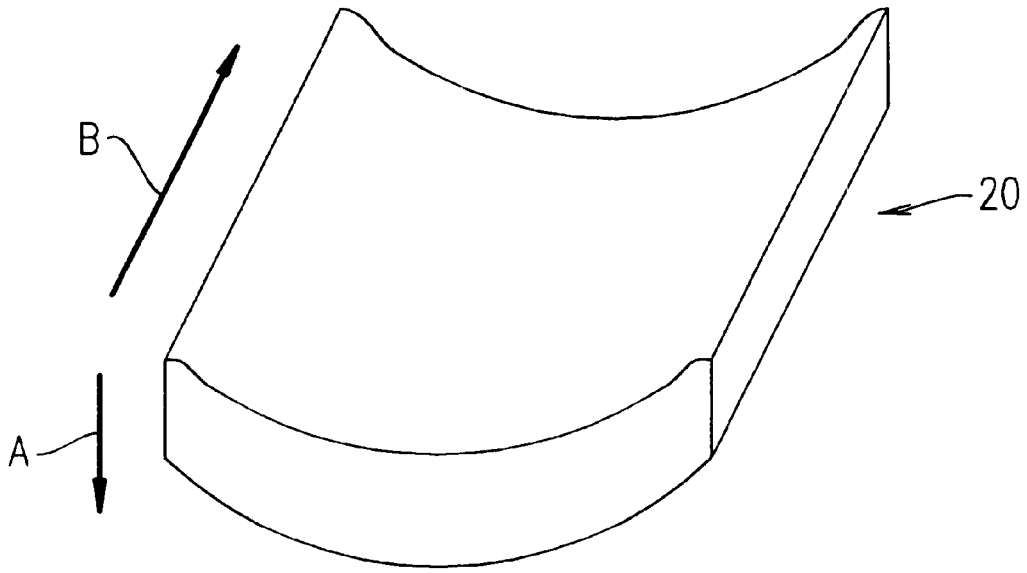
FIG. 2 is a perspective view illustrating an arc-shaped rare-earth magnet produced in one embodiment of the present invention.

As illustrated in FIG. 2, the shape of the die set used in the present embodiment is designed so as to produce a thin-plate rare-earth magnet 20 having at least one arced surface, and preferably in an arc shape. The rare-earth magnet 20 is magnetized in a direction parallel to the direction indicated by arrow A in FIG. 2, which is parallel to the pressing direction. The rare-earth magnet illustrated in FIG. 2 can be used as, for example, a part of a voice coil motor or other rotating machines. When used in a motor, the shape of the magnet 20 is preferably designed so that a skew occurs in order to reduce the undesirable cogging torque.

Referring back to FIG. 1A, a cavity is formed above the lower punch 16 with the upper portion of the lower punch 16 being partially inserted in the through hole of the die 12. The cavity is filled with a magnetic powder 18 by moving a feeder box (not shown) carrying the magnetic powder over the cavity and letting the powder fall from the bottom opening of the feeder box into the cavity. Since the powder filling cannot be uniform with only the gravitational force, it is preferred to horizontally vibrate a shaker (not shown) in the feeder box to force the magnetic powder 18 into the cavity. Such a shaker is disclosed in copending U.S. patent application Ser. No. 09/472,247, issued as U.S. Pat. No. 6,299,832, the disclosure of which is incorporated herein by reference.

When the feeder box is retracted from the position over the cavity, the upper portion of the filling powder 18 is flattened out by the bottom edge of the feeder box, whereby it is possible to precisely fill the cavity with a predetermined amount of the powder 18 to be compacted.

A characteristic feature of the compacting apparatus 10 of the present embodiment is that a novel surface pattern is provided on the pressing surface 14*a* of the upper punch 14 and the pressing surface 16*a* of the lower punch 16. The details of the surface pattern provided on the pressing surfaces 14*a* and 16*a* are described hereinbelow.

After the cavity is filled with the magnetic powder 18, the upper punch 14 starts to move toward the lower punch 16. The pressing surface 14*a* of the upper punch 14 presses the upper surface of the underlying powder 18 as illustrated in FIG. 1B. After the magnetic powder 18 in the cavity is essentially completely sealed by the upper punch 14, the lower punch 16 and the die 12, a magnetic field generation coil (not shown) applies an orientation magnetic field to the magnetic powder 18 in the cavity. A magnetic flux is guided into the upper punch 14 and the lower punch 16, and the direction of the orientation magnetic field in the cavity becomes parallel to the pressing direction (the direction in which the upper punch is moved). The powder particles about to be pressed are aligned by the orientation magnetic field in the direction of the magnetic field.

With the orientation magnetic field being applied to the powder, the alloy powder in the cavity is compressed and compacted by the upper punch 14 and the lower punch 16, thereby forming a powder compact 24. In the pressing step, the pressurized powder particles are subject to different stresses (pressures) depending upon the location. After the compact 24 is formed, the upper punch 14 is lifted, the lower punch 16 pushes up the compact 24, and the compact 24 is taken out of the die 12.

Figure 3A:
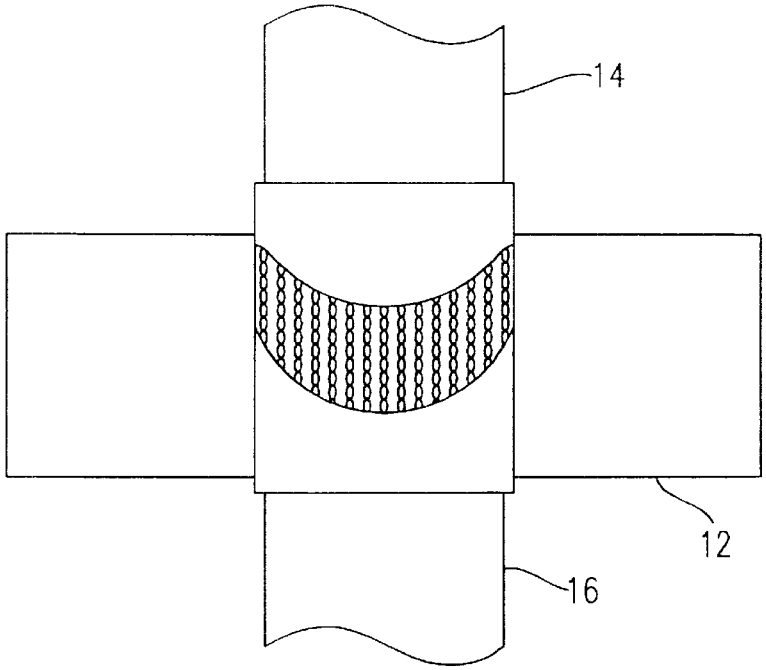
FIG. 3A is a cross-sectional view schematically illustrating the state of a powder in an initial stage of a pressing step using a conventional compacting apparatus.
Figure 3B:
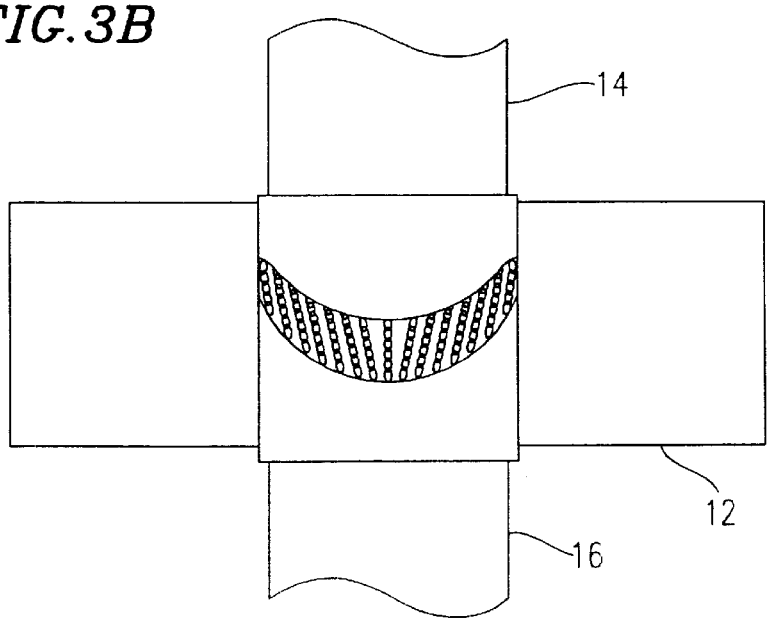
FIG. 3B is a cross-sectional view schematically illustrating the state of the powder in a late stage of the pressing step.

FIG. 3A schematically illustrates the state of a powder in an initial stage of a pressing step using a conventional compacting apparatus. FIG. 3B schematically illustrates the state of the powder in a late stage of the pressing step.

The individual particles of the magnetic powder placed in an orientation magnetic field are aligned in the direction of the orientation magnetic field and are strongly magnetically coupled with other powder particles. As a result, powder particles are arranged in arrays extending in the direction of the orientation magnetic field as illustrated in FIG. 3A. As the distance between the upper punch 14 and the lower punch 16 is reduced in the presence of an applied orientation magnetic field, non-uniform pressures (stresses) are applied to different portions of the powder to be pressurized because the pressing surfaces 14*a* and 16*a* have a curved surface. If the pressing surfaces 14*a* and 16*a* are mirror-finished smooth surfaces, the powder particles slide laterally along the smooth pressing surfaces 14*a* and 16*a*, whereby the orientation direction becomes non-uniform, as illustrated in FIG. 3B.

Figure 4A:
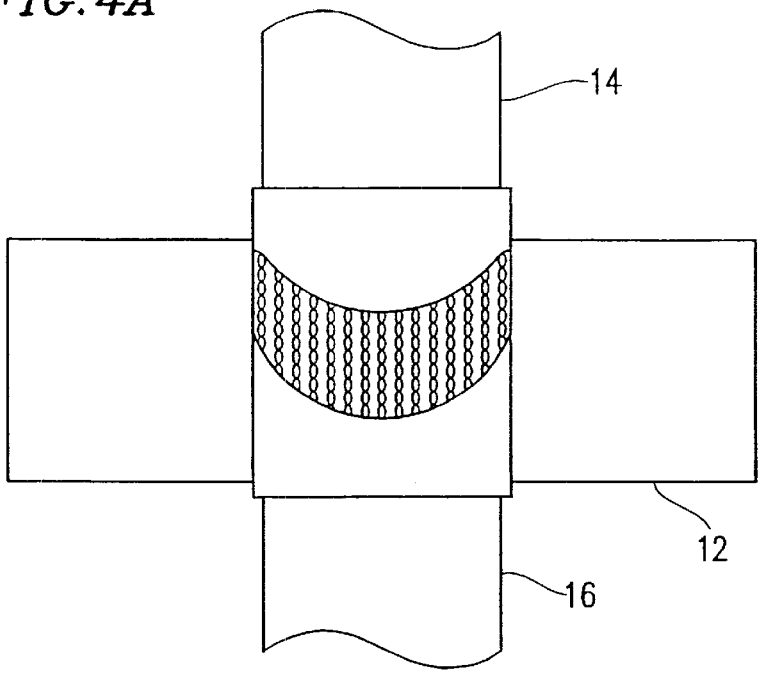
FIG. 4A is a cross-sectional view schematically illustrating the state of a powder in an initial stage of a pressing step using a compacting apparatus according to one embodiment of the present invention.
Figure 4B:
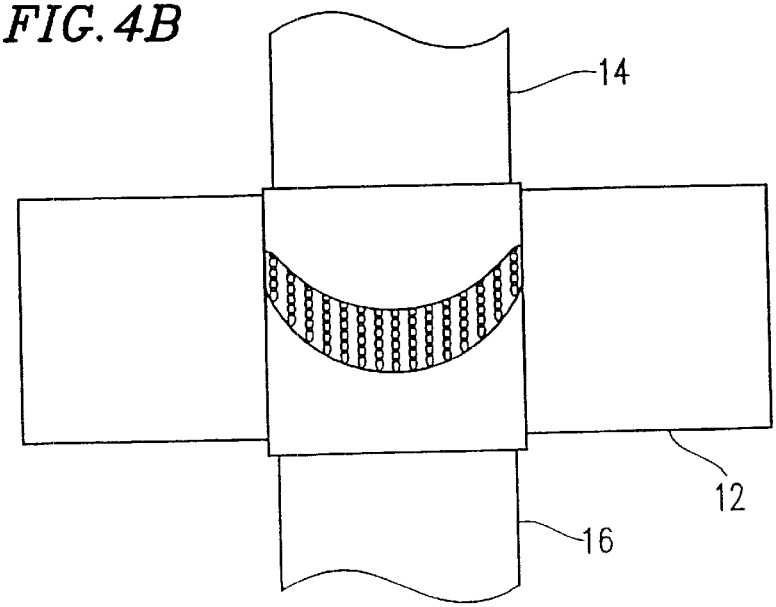
FIG. 4B is a cross-sectional view schematically illustrating the state of the powder in a late stage of the pressing step.

In contrast, according to the present embodiment, it is possible to suppress the slide of the powder particles near the pressing surface, thereby preventing the orientation disturbance, as illustrated in FIG. 4A and FIG. 4B. This is achieved by a minute concave/convex pattern provided on the pressing surface of each of the upper and lower punches 14 and 16 suppressing the slide of the powder particles along the pressing surface.

Since the magnetic powder particles in a magnetic field are magnetically coupled with one another as described above, the motion of the powder particles in the interior portion of the cavity is strongly influenced by the motion of the powder particles in the vicinity of the pressing surface. Therefore, by providing the pressing surface with a novel surface shape, it is possible to suppress the reduction in the degree of orientation for the entire powder in the cavity.

Next, a specific structure of the pressing surface 16*a* of the lower punch 16 used in the present embodiment will be described. The pressing surface 14*a* of the upper punch 14 also has a similar structure.

Figure 5A:
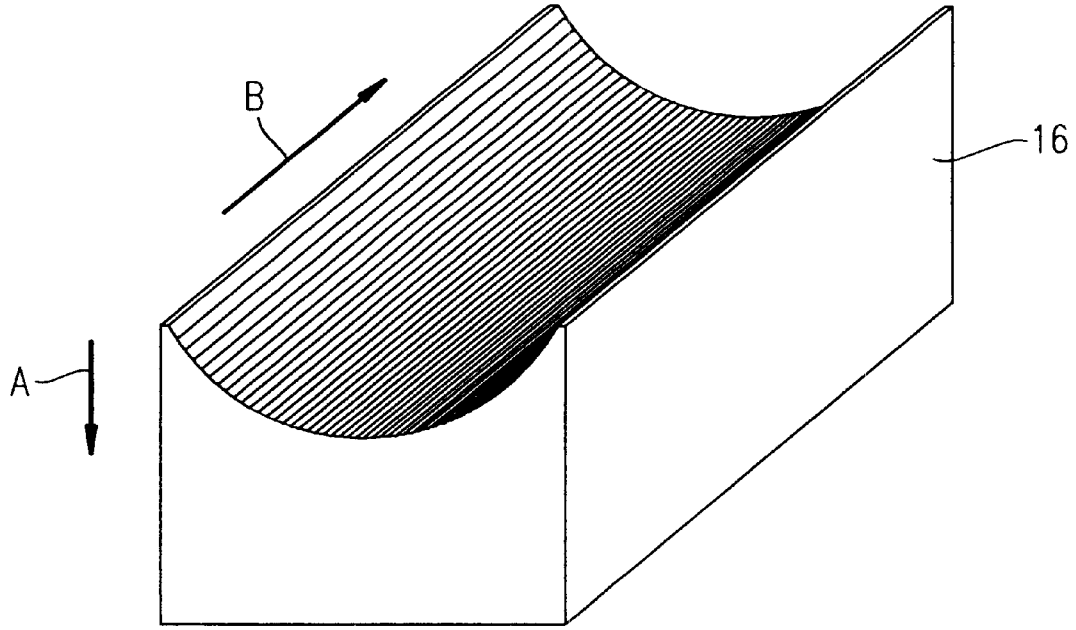
FIG. 5B is a perspective view illustrating a lower punch 16 having a pressing surface used in one embodiment of the present invention.
Figure 5B:
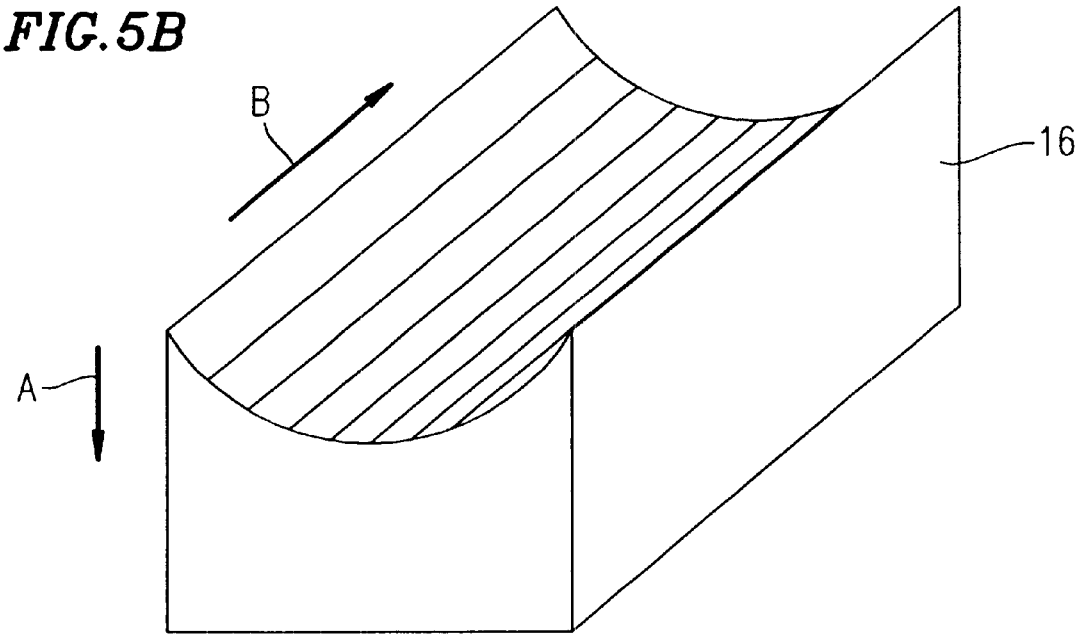
Figure 6A:
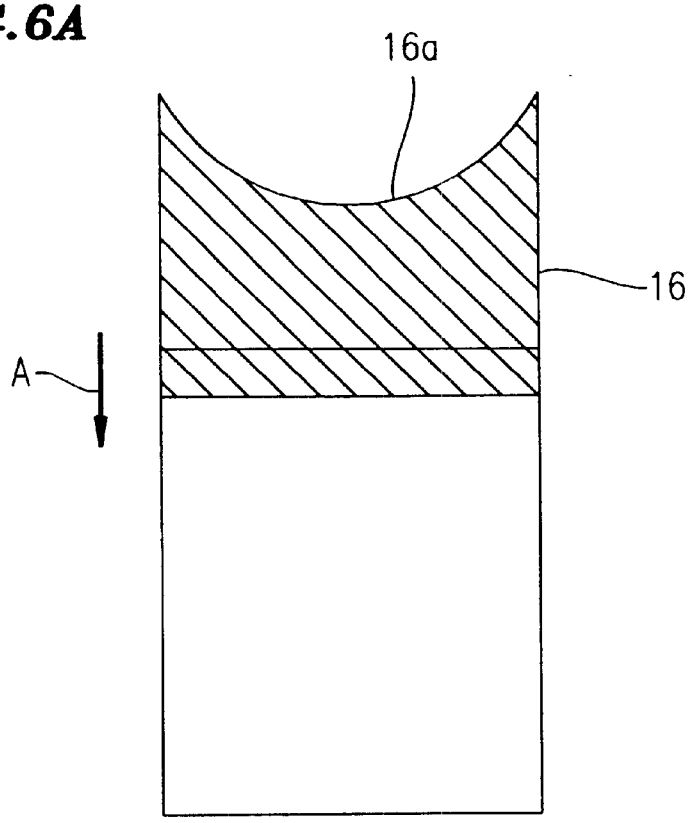
FIG. 6A is a cross-sectional view illustrating the lower punch of FIG. 5A.
Figure 6B:
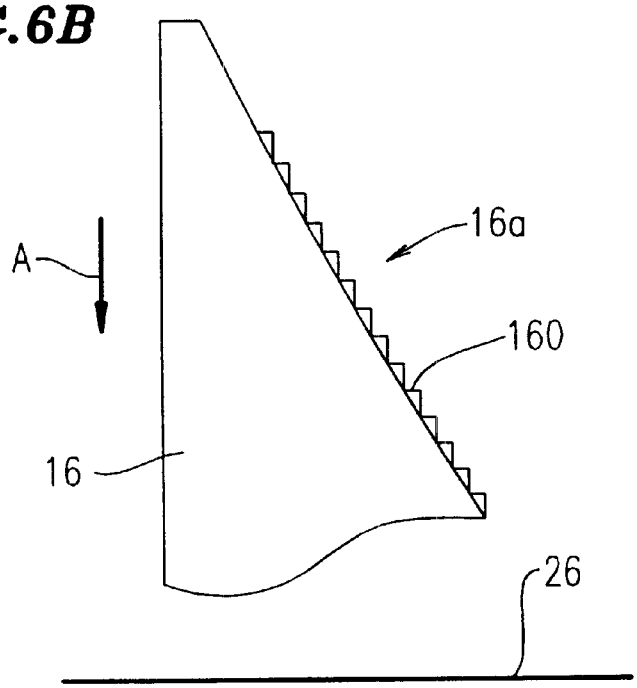
FIG. 6B is an enlarged cross-sectional view illustrating a portion of the lower punch.

FIG. 5A and FIG. 5B respectively illustrate two different surface shapes for the pressing surface 16*a* of the lower punch 16 used in the present embodiment. FIG. 6A is a cross-sectional view illustrating the pressing surface 16*a* of FIG. 5A, and FIG. 6B is an enlarged cross-sectional view illustrating a portion thereof. As can be seen from FIG. 6B, the surface pattern of the pressing surface 16*a* includes a plurality of minute surfaces 160 that are generally parallel to a reference plane 26 perpendicular to the pressing direction A, and there is a step between adjacent minute surfaces 160. The width and pitch of the minute surfaces 160 is, for example, 0.1 mm. The minute surfaces 160 extend in a single direction (the direction parallel to arrow B) as illustrated in FIG. 5A. The pressing surface 16*a* as described above can be formed by machining the surface of an ordinarily made punch member with a ball end mill, or the like.

During the compression of the powder, the powder particles located near the pressing surface are not likely to slide in the direction indicated by arrow B on FIG. 5A for the following reason.

First, the vector of the force that is exerted by the pressing surface 16*a* upon the powder particles in contact with the pressing surface 16*a* during the pressing process will be considered. The vector is perpendicular to arrow B. Therefore, the powder particles are not subject to a force parallel to arrow B from the pressing surface 16*a*, and thus the slide of the powder particles in the direction of arrow B can be ignored.

The vector is generally parallel to arrow A in the center of the pressing surface, but in other areas, the vector has a component that is not parallel to arrow A. This is a component of a potential force urging the powder particles to slide. However, if a surface structure as that of the present embodiment is provided on the pressing surface 16*a*, the slide of the powder particles is suppressed by the surface structure.

While the pressing surface 16*a* as illustrated in FIG. 6B includes many steps that are formed by the minute surfaces 160 parallel to the reference plane 26, the minute surfaces 160 are not necessarily required to be parallel to the reference plane 26. The pressing surface may alternatively include many grooves having a V-shaped or rectangular cross section, which would sufficiently suppress the slide of the powder particles near the pressing surface in a direction across the grooves.

Figure 7A:
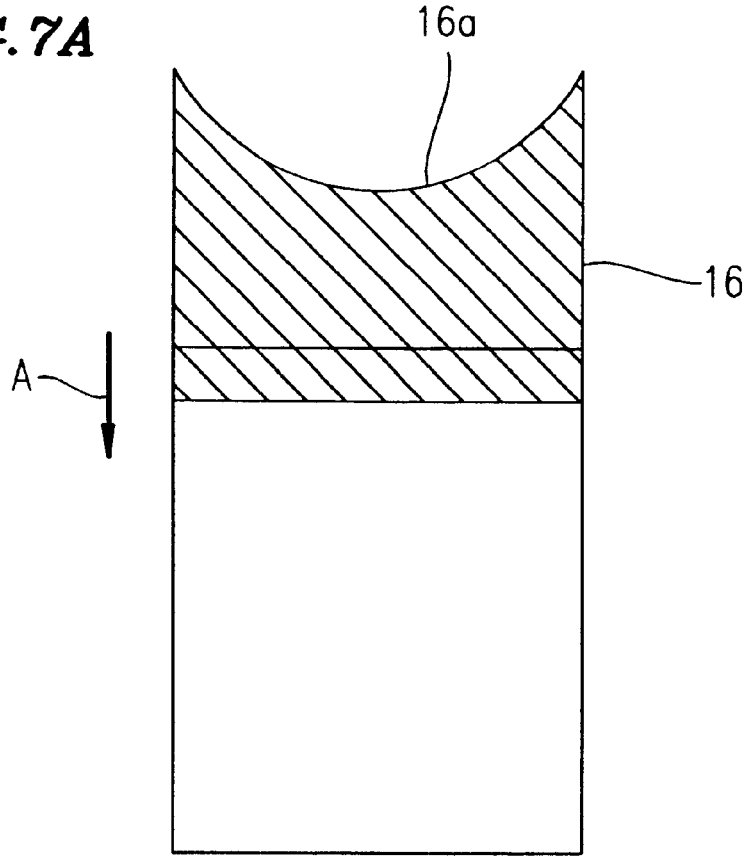
FIG. 7A is a cross-sectional view illustrating the lower punch of FIG. 5B.
Figure 7B:
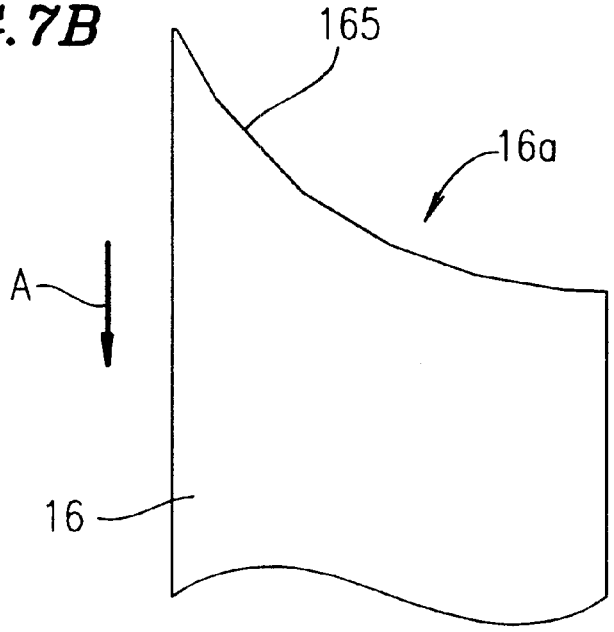
FIG. 7B is an enlarged cross-sectional view illustrating a portion of the lower punch.

Next, the pressing surface 16*a* illustrated in FIG. 5B will be described. FIG. 7A is a cross-sectional view illustrating the pressing surface 16*a* and FIG. 7B is an enlarged cross-sectional view illustrating a portion thereof. As can be seen from FIG. 7B, the pressing surface 16*a* includes a plurality of strip-shaped flat surfaces 165, preferably of a width of 2 to 20 mm, and the cross section of the pressing surface 16*a* has a polygonal shape.

Either pressing surface 16*a* described above has a function of suppressing the slide of the powder particles in contact with the pressing surface 16*a* along the pressing surface 16*a*. In order to more efficiently prevent the slide of the powder particles and to realize a good mold release property, it is preferred to set the surface roughness Ra of the pressing surface 16*a* to be equal to or greater than 0.05 $\mu$m and less than or equal to 25 $\mu$m.

In the example illustrated in FIG. 5A and FIG. 5B, the curved pressing surface 16*a* includes a plurality of surfaces extending in a single direction. However, the surface pattern of the pressing surface is not limited to this. An important point of the present invention is that the pressing surface is provided with a pattern such that the powder particles to be pressurized are unlikely to slide along the pressing surface. Therefore, many minute concave portions and/or convex portions each having a dot-shape or another shape may be arranged on the pressing surface. In such a case, it is preferred to set the depth of the concave portions to be 0.1 mm or less and the height of the convex portions to be 0.1 mm or less in order to improve the mold release property of the compact. This is because when the pressing surface (the contact surface of a punch) has concave/convex portions bigger than 0.1 mm, some powder particles remain on the pressing surface, thereby making the compaction more difficult. When compacting a powder having a small average grain diameter and a narrow size distribution, such as a rare-earth magnetic powder made by a strip casting method, it is necessary to press the powder with a greater pressure than that used when compacting other powders. In such a case, a pressing pressure greater than a normal pressing pressure by about 10% to about 20%, for example, is required. Where a powder is compacted with such a great pressure, if the concave/convex portions of the pressing surface are bigger than 0.1 mm, the compact may expand due to a spring back occurring when pulling out the compact, whereby some powder particles may possibly remain on the surface of the concave/convex portions or the compact may possibly be broken apart.

Where grooves or steps are formed on the pressing surface, additional grooves or steps running across the grooves or steps may be formed.

As described above, according to the present invention, the surface structure formed on the pressing surface gives the powder particles a force that prevents the slide of the powder particles in contact with the pressing surface of a punch along the pressing surface during the pressing process. Such a surface structure of the pressing surface plays its roll during the pressing step, and is unnecessary for the surface of the final rare-earth magnet product. Even if the pattern of the surface structure of the pressing surface is transferred onto the surface of the magnet, the pattern can be easily removed by subsequently polishing the magnet surface, thereby smoothing the magnet surface.

Figure 9:
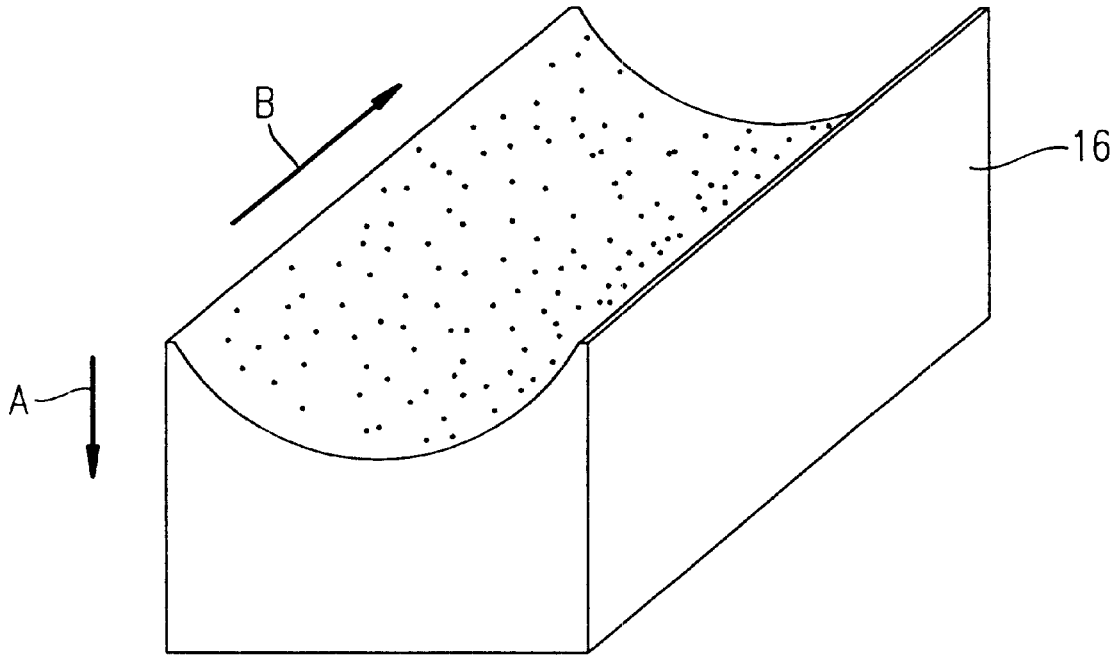
FIG. 9 is a perspective view illustrating the lower punch used in another embodiment of the present invention.

Instead of providing the pressing surface with a stepped shape as described above, a curved surface may be formed by an electric discharge machining method, for example, with the pressing surface being left rough without subjecting the surface to a mirror-finish process. FIG. 9 illustrates the pressing surface of a punch that is formed by an electric discharge machining method. The effects as those described above can be obtained also when minute concave portions and/or convex portions are formed on the pressing surface as illustrated in FIG. 9. A punch having such a pressing surface is easier to make than a punch having a stepped cross section. It is preferable to adjust the surface roughness Ra of the pressing surface in the range of 0.05 $\mu$m to 12.5 $\mu$m. During the press-compaction in a magnetic field, the powder is secured by the convex portions of the pressing surface so that it does not slide laterally, whereby the orientation disturbance is minimized. Moreover, since an appropriate amount of air and/or mold release agent remains in the concave portions of the pressing surface even after the press-compaction, the adherence between the press-compaction surface and the compact is reduced. This prevents a portion of the compact from being peeled off when taking out the compact. When electric discharge machining is performed, as compared to when milling cutter machining or end mill machining is performed, non-directional concave/convex portions are likely to be formed randomly. Moreover, since the concave/convex portions on the machined surface are rounded by the heat generated during the electric discharge machining, it is possible to make a punch with which the disturbance in powder orientation is unlikely to occur, and which has a good mold release property.

It is preferred to use a non-magnetic material to make the upper punch 14 and the lower punch 16 each having a pressing surface of the structure as described above, because a magnetic flux for forming a magnetic field parallel to the pressing direction is passed therethrough during the pressing step. As such a material, it is preferred to choose a WC—Ni cemented carbide material, for example.

In order to obtain a magnet having a parallel orientation direction and a uniform magnetic flux density, it is preferred that the tip portion of each of the upper punch 14 and the lower punch 16 that contacts the magnetic powder is made of a magnetic material having a saturation magnetization of about 0.05 to about 1.2 T (Tesla) as described in Japanese Laid-Open Patent Publication No. 9-35978.

Method of Producing Alloy Powder

A cast piece of an R—Fe—B rare-earth magnetic alloy is made by using a known strip casting method. Specifically, an alloy having a composition of 30 wt % of Nd, 1.0 wt % of B, 1.2 wt % of Dy, 0.2 wt % of Al, and 0.9 wt % of Co, with the balance being the amount of Fe and unavoidable impurities, is first melted in a high frequency melting process to obtain a molten alloy. After maintaining the molten alloy at 1350 C., the molten alloy is rapidly cooled by a single chill roll method so as to obtain a solidified alloy having a thickness of 0.3 mm. The cooling conditions include, for example, a roll circumferential speed of about 1 m/sec, a cooling rate of 500° C./sec and a sub-cooling degree of 180° C. The cooling rate may be $10^2$–$10^{4}$° C./sec.

The rapidly cooled alloy thus obtained has a thickness of 0.03–10 mm. The alloy contains $R_2T_{14}B$ crystal grains whose size in the short axis direction is equal to or greater than 0.1 $\mu$m and less than or equal to 100 $\mu$m and whose size in the long axis direction is equal to or greater than 5 $\mu$m and less than or equal to 500 $\mu$m, and an R-rich phase that exists dispersed along the grain boundaries of the $R_2T_{14}B$ crystal grains. The thickness of the R-rich phase is 10 μm or less. A method of producing a raw material alloy by a strip casting method is disclosed in, for example, U.S. Pat. No. 5,383,978.

Next, the alloy is coarsely pulverized and filled into a plurality of raw material packs and mounted on a rack. Then, the rack with the raw material packs mounted thereon is transferred to a position in front of a hydrogen furnace by using the raw material transfer device, and the rack is inserted into the hydrogen furnace. Then, a hydrogen pulverization process is started in the hydrogen furnace. The raw material alloy is heated in the hydrogen furnace and undergoes a hydrogen pulverization process. After the pulverization, the material is taken out preferably after the temperature of the material alloy has decreased to around room temperature. However, even when the material is taken out at a high temperature (e.g., 40 to 80° C.), a serious degree of oxidization will not occur if it is ensured that the material does not contact the atmosphere. Through the hydrogen pulverization, the rare-earth alloy is pulverized to a size of about 0.1 to 1.0 mm. It is preferred that the alloy is coarsely pulverized into flakes having an average grain diameter of 1 to 10 mm before the hydrogen pulverization process.

It is preferred that after the hydrogen pulverization, the embrittled material alloy is further pulverized and cooled by using a cooling device such as a rotary cooler. When the material is taken out at a relatively high temperature, the duration of the cooling process using a rotary cooler, or the like, can be increased accordingly.

The raw material powder that has been cooled to around room temperature by using a rotary cooler, or the like, is further pulverized by using a pulverization device such as a jet mill, thereby producing a fine powder material. In the present embodiment, a fine pulverization process was carried out by using a jet mill in a nitrogen gas atmosphere to obtain an alloy powder having an average grain diameter of about 3.5 μm. The amount of oxygen in the nitrogen gas atmosphere is preferably as small as about 100 ppm. Such a jet mill is described in Japanese Patent Publication for Opposition No. 6-6728. It is preferred to control the concentration of an oxidizing gas (oxygen and water vapor) contained in the atmosphere gas used in the pulverization process so as to adjust the oxygen content of the alloy powder after the fine pulverization process to be 6000 ppm (by weight) or less. This is because if the rare-earth alloy powder contains an excessive amount of oxygen over 6000 ppm, the proportion of a non-magnetic oxide in the magnet increases, thereby deteriorating the magnetic properties of the final sintered magnet product.

Next, a lubricant in an amount of 0.3 wt %, for example, is added and mixed in the alloy powder in a rocking mixer so as to cover the surface of the alloy powder particles with the lubricant. The lubricant may be a lubricant obtained by diluting a fatty acid ester with a petroleum solvent. In the present embodiment, methyl caproate is used as a fatty acid ester and isoparaffin as a petroleum solvent. The weight ratio between methyl caproate and isoparaffin is, for example, 1:9. Such a liquid lubricant covers the surface of the powder particles, preventing the particles from being oxidized and improving the orientation property during a pressing process and facilitating the removal of the compact following a pressing process.

The type of lubricant is not limited to the above. Instead of methyl caproate, the fatty acid ester may be, for example, methyl caprylate, methyl laurylate, methyl laurate, or the like. The solvent may be a petroleum solvent such as isoparaffin, a naphthenic solvent, or the like. The lubricant may be added at any timing, i.e., before the fine pulverization, during the fine pulverization or after the fine pulverization. A solid dry lubricant such as zinc stearate may be used instead of, or in addition to, a liquid lubricant.

Because of its sharp grain size distribution, a powder produced by the present method generally has a tendency to have its orientation disturbed during the pressing process. While the addition of a lubricant such as a fatty acid ester facilitates the orientation of the individual particles, it deteriorates the powder flowability, whereby the orientation is likely to be disturbed while being pressed. Thus, the effect of the pressing surface machining is expressed prominently in the present embodiment.

Method of Producing Rare-Earth Magnet

First, a magnetic powder produced by the above-described method is pressed and compacted in an orientation magnetic field using the compacting apparatus illustrated in FIG. 1. After completion of the press-compaction, the obtained powder compact is pushed up by the lower punch 16, and is ejected out of the compacting apparatus. At this point, a pattern reflecting the surface pattern of the pressing surface 14*a* and a pattern reflecting the surface pattern of the pressing surface 16*a* have been transferred respectively on the surfaces of the compact (the surfaces that were respectively in contact with the upper punches 14 and 16). According to the present embodiment, it is possible to obtain a uniformly aligned powder compact with little disturbance in its orientation as illustrated in FIG. 4B.

In order to enhance the mold release property for the step of releasing the compact from the die, a mold release agent may be applied/dispersed on the pressing surface before the powder-filling step. As the mold release agent, a mold release agent obtained by diluting a fatty acid ester with a solvent can suitably be used. Specific examples of the fatty acid ester include methyl caproate, methyl caprylate, methyl laurylate, methyl laurate, and the like. The solvent may be a petroleum solvent such as isoparaffin, or the like. Any of those obtained by mixing together a fatty acid ester and a solvent at a weight ratio of 1:20 to 1:1 (fatty acid ester:solvent). As a fatty acid, arachidic acid may be contained in an amount of 1.0 wt % or less.

Then, the compact is placed on a sintering base plate (thickness: 0.5 to 3 mm). The base plate is made of, for example, a molybdenum material. The compact 24 is placed in a sintering case together with the base plate. The sintering case holding the compact to be sintered is transferred into a sintering furnace and undergoes a known sintering process in the furnace. The compact changes into a sintered body through the sintering process.

Then, a polishing process is performed on the surface of the sintered body, as necessary. Immediately after the sintering, a surface pattern corresponding to the surface pattern of the pressing surface remains on the surface of the sintered body. A part or whole of the surface pattern may be removed by the polishing process. After, or in place of, the polishing process, it is possible to perform a step of coating the surface of the sintered body with a resin film, or the like. Thus, the final product, i.e., a rare-earth magnet, is produced.

An embodiment of the present invention has been described above with respect to a rare-earth magnet having a shape suitable for use in a rotating machine such as a motor. However, the present invention is not limited to this.

While the upper surface and the lower surface of the magnet illustrated in FIG. 2 are both curved, the effects of the present invention can be sufficiently obtained also in a case where only one of the surfaces is curved. In such a case, the pressing surface of one of the punches for forming the uncurved flat surface may have a smooth flat surface as in the prior art.

Moreover, the present invention is effective also in a case of producing a magnet having a surface that is curved as a portion of a spherical surface. In such a case, the minute surfaces forming a pressing surface are arranged in a concentric pattern.

While the term "curved pressing surface" is used herein, it is understood that the term "curved pressing surface" includes a pressing surface that is curved macroscopically, but includes "uncurved portion(s)" microscopically.

Example and Comparative Example

A rare-earth alloy powder made by the method described above was press-compacted using a compacting apparatus having the lower punch 16 as illustrated in FIG. 5A and FIG. 5B. In the compact produced in this example, the length as measured in the direction indicated by arrow B of FIG. 2 was 40 mm, the thickness as measured in the direction indicated by arrow A was 7 mm in the central portion and 4 mm in the peripheral portion, and the width as measured in the direction perpendicular to both arrows A and B was 35 mm. An orientation magnetic field (about 1 MA/m) was applied in parallel to the pressing direction (arrow A), with the compact density being 4.30 g/cm$^3$. Then, the compact was sintered in an argon atmosphere at 1050° C. for two hours to obtain a magnet. After the magnet was magnetized, the magnetic flux density distribution in the vicinity of the magnet surface was measured.

As a comparative example, another magnet was made through a similar pressing step but with a compacting apparatus including a lower punch with a mirror-finished pressing surface.

The magnetic flux density distribution measured for the example of the present invention was better than that measured for the comparative example, and no distribution abnormality due to a decrease in the degree of orientation was observed.

A comparison between an example made by using a punch having a surface shape as illustrated in FIG. 5A and another example made by using a punch having a surface shape as illustrated in FIG. 5B showed that there is no significant difference therebetween in terms of the magnetic properties, but the punch illustrated in FIG. 5B exhibited a better result in terms of the mold release property of the compact. Note, however, that even in a case where the punch illustrated in FIG. 5A is used, a sufficient mold release property can be exerted if the width or pitch of the minute surfaces is in the range of about 0.01 to about 5 mm.

Figure 8A:
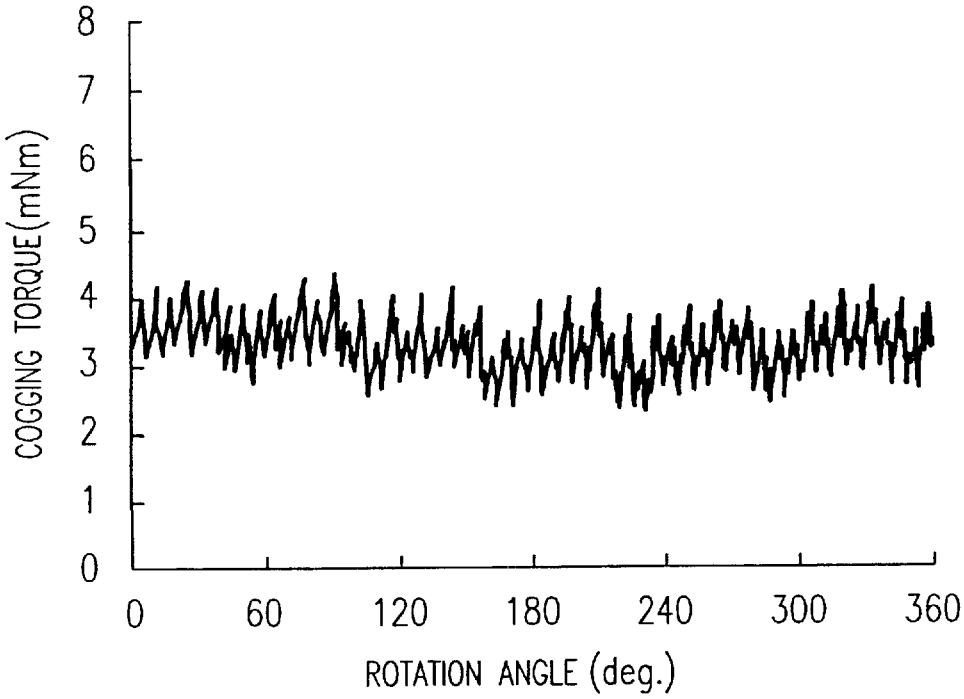
FIG. 8A is a graph illustrating the cogging torque of a motor made by using a magnet of an example of the present invention.

Then, the cogging torque of a motor made by using the magnet of the example of the present invention was measured. The measurement results are shown in FIG. 8A. For the purpose of comparison, the cogging torque of another magnet made by using the magnet of the comparative example was also measured. The measurement results are shown in FIG. 8B.

Figure 8B:
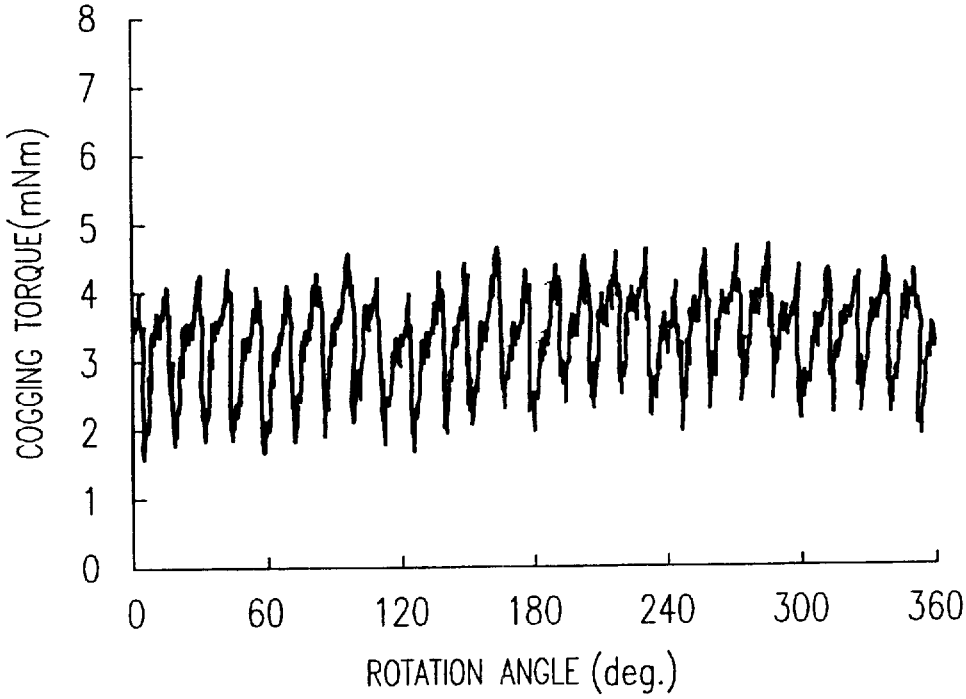
FIG. 8B is a graph illustrating the cogging torque of a motor made by using a magnet of a comparative example.

As is apparent from FIG. 8A and FIG. 8B, the undesirable cogging torque of the example of the present invention is sufficiently smaller than that of the comparative example. With the present invention, the undesirable cogging torque of a motor is reduced because the orientation disturbance is unlikely to occur in the compact during the pressing step.

With the compacting apparatus of the present invention, a concave/convex pattern is formed on the pressing surface, thereby suppressing the slide of powder particles along the pressing surface while the powder is pressed in an orientation magnetic field, and thus preventing the disturbance in powder orientation.

In a powder compact formed by using such a compacting apparatus, a uniform orientation is achieved, whereby a rare-earth magnet made by using such a compact has desirable magnetic properties.

When a motor is assembled using a magnet produced by the method of the present invention, it is possible to reduce the undesirable cogging torque.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention that fall within the true spirit and scope of the invention.

We claim:

1. A powder compacting apparatus for pressing powder in a pressing process, comprising:

a die having a through hole forming a cavity;

an upper punch and a lower punch for pressing a rare-earth alloy magnetic powder filled in said cavity in a pressing direction; and magnetic field generation means for applying an orientation magnetic field parallel to said pressing direction through the rare-earth alloy magnetic powder in said cavity, wherein:

said upper punch and said lower punch have a convex curved pressing surface and a concave curved pressing surface, respectively;

at least one of said convex curved pressing surface and a concave curved pressing surface is shaped to suppress movement of particles of the rare-earth alloy magnetic powder along said pressing surface during said pressing process.

2. The powder compacting apparatus according to claim 1, wherein said at least one pressing surface comprises a pattern formed on said at least one pressing surface, said pattern including at least one of concave portions and convex portions, said pattern extending in a direction generally parallel to a reference plane that is perpendicular to said pressing direction.

3. The powder compacting apparatus according to claim 1, wherein:

said at least one pressing surface comprises parallel minute surfaces extending in a direction generally parallel to a reference plane that is perpendicular to said pressing direction; and each of said minute surfaces is separated from adjacent minute surfaces by a step.

4. The powder compacting apparatus according to claim 3, wherein each of said minute surfaces has a width of 0.1 mm or less.

5. The powder compacting apparatus according to claim 1, wherein said at least one pressing surface comprises an arrangement of at least one of concave portions and convex portions on said at least one pressing surface, said arrangement of concave portions having a depth of not more than 0.1 mm and said arrangement of convex portions having a height of not more than 0.1 mm.

6. The powder compacting apparatus according to claim 5, wherein said at least one pressing surface has a surface roughness Ra between 0.05 $\mu$m and 12.5 $\mu$m.

7. The powder compacting apparatus according to claim 1, wherein said at least one pressing surface is curved in an arch shape.

8. A method of making a rare-earth alloy magnetic powder compact, comprising the steps of:

providing a powder compacting apparatus; and using said powder compacting apparatus to compact a rare-earth alloy magnetic powder, wherein said powder compacting apparatus for pressing powder in a pressing process, comprising:

a die having a through hole forming a cavity;

a first punch and a second punch for pressing a rare-earth alloy magnetic powder filled in said cavity in a pressing direction; and magnetic field generation means for applying a orientation magnetic field parallel to said pressing direction through the rare-earth alloy magnetic powder in said cavity, wherein;

at least one of said first and second punches has a curved pressing surface; and said pressing surface is shaped to suppress movement of particles of the rare-earth alloy magnetic powder along said pressing surface during said pressing process.

9. The method according to claim 8, further comprising the step of forming a rare-earth alloy magnetic powder from an Fe—R—B alloy, wherein R denotes a rare-earth element and B denotes boron.

10. A method of producing a rare-earth magnet, comprising the steps of:

providing a powder compacting apparatus;

using said powder compacting apparatus to form a compact of a rare-earth alloy magnetic powder; and making a permanent magnet from the compact, wherein said powder compacting apparatus for pressing powder in a pressing process, comprising:

a die having a through hole forming a cavity;

a first punch and a second punch for pressing a rare-earth alloy magnetic powder filled in said cavity in a pressing direction; and magnetic field generation means for applying a orientation magnetic field parallel to said pressing direction through the rare-earth alloy magnetic powder in said cavity, wherein;

at least one of said first and second punches has a curved pressing surface; and said pressing surface is shaped to suppress movement of particles of the rare-earth alloy magnetic powder along said pressing surface during said pressing process.

11. The method according to claim 10, further comprising the step of forming a rare-earth alloy magnetic powder from an Fe—R—B alloy, wherein R denotes a rare-earth element and B denotes boron.

12. The powder pressing die set, comprising an upper punch and a lower punch having a convex curved pressing surface and a concave curved pressing surface, respectively, for pressing powder particles in said die set during a pressing process;

wherein at least one of said convex curved pressing surface and a concave curved pressing surface is shaped to suppress movement of powder particles along the at least one pressing surface during said pressing process.

13. The powder pressing die set according to claim 12, wherein a pattern is formed on said at least one pressing surface, said pattern including at least one of concave portions and convex portions extending in a direction generally parallel to a reference plane that is perpendicular to a pressing direction.

14. The powder pressing die set according to claim 12, wherein:

said at least one pressing surface comprises parallel minute surfaces extending in a direction generally parallel to a reference plane that is perpendicular to said pressing direction; and each of said minute surfaces is separated from adjacent minute surfaces by a step.

15. The powder pressing die set according to claim 14, wherein each of said minute surfaces has a width of 0.1 mm or less.

16. The powder pressing die set according to claim 12, wherein said at least one pressing surface comprises an arrangement of at least one of concave portions and convex portions on said at least one pressing surface, said arrangement of concave portions having a depth of not more than 0.1 mm and said arrangement of convex portions having a height of not more than 0.1 mm.

17. The powder pressing die set according to claim 16, wherein said at least one pressing surface has a surface roughness Ra between 0.05 $\mu$m and 12.5 $\mu$m.

18. The powder pressing die set according to claim 12, wherein the at least one pressing surface is curved in an arch shape.

19. A rare-earth magnet formed from being pressed in a direction, wherein a pattern is formed on a surface thereof, said pattern including at least one of concave portions and convex portions extending in a direction generally parallel to a reference plane that is perpendicular to said pressing direction.

20. A rare-earth magnet formed by pressing magnet powder in a pressing direction, said magnet comprising:

a surface including a plurality of parallel minute surfaces extending in a direction generally parallel to a reference plane that is perpendicular to said pressing direction, each of said minute surfaces is separated from adjacent minute surfaces by a step.

21. The rare-earth magnet according to claim 20, wherein each of said minute surfaces has a width of 0.1 mm or less.

22. A rare-earth magnet formed by pressing magnet powder in a pressing direction, comprising a surface including a plurality of strip-shaped flat surfaces extending in a direction generally parallel to a reference plane that is perpendicular to a pressing direction.

23. The powder compacting apparatus according to claim 1, further comprising a feeder box to fill said cavity with the rare-earth alloy magnetic powder and to flatten the upper portion of the rare-earth alloy magnetic powder filled in the cavity.

24. The method according to claim 9, wherein the Fe—R—B alloy is a rapidly cooled one.

25. The method according to claim 11, wherein the Fe—R—B alloy is a rapidly cooled one.

26. A powder compacting apparatus for pressing powder in a pressing process, comprising:

a die having a through hole forming a cavity;

a first punch and a second punch for pressing a rare-earth alloy magnetic powder filled in said cavity in a pressing direction; and magnetic field generation means for applying an orientation magnetic field parallel to said pressing direction through the rare-earth alloy magnetic powder in said cavity, wherein:

at least one of said first and second punches has a curved pressing surface;

said pressing surface is shaped to suppress movement of particles of rare-earth alloy magnetic powder along said pressing surface during said pressing process;

said pressing surface comprises parallel minute surfaces extending in a direction generally parallel to a reference plane that is perpendicular to said pressing direction; and each of said minute surfaces is separated from adjacent minute surfaces by a step.

27. The powder compacting apparatus according to claim 26, wherein each of said minute surfaces has a width of 0.1 mm or less.

28. A powder compacting apparatus for pressing powder in a pressing process, comprising:

a die having a through hole forming a cavity;

a first punch and a second punch for pressing a rare-earth alloy magnetic powder filled in said cavity in a pressing direction; and magnetic filed generation means for applying an orientation magnetic field parallel to said pressing direction through the rare-earth alloy magnetic powder in said cavity, wherein:

at least one of said first and a second punches has a curved pressing surface;

said pressing surface is shaped to suppress movement of particles of the rare-earth alloy magnetic powder along said pressing surface during said pressing process; and said pressing surface comprises a non-directional concave/convex portions formed randomly.

29. The powder compacting apparatus according to claim 28, wherein said pressing surface has a surface roughness Ra between 0.05 $\mu$m and 12.5 $\mu$m.

* * * * *